US005714297A

United States Patent [19]

Chamberlain et al.

[11] Patent Number: 5,714,297

[45] Date of Patent: Feb. 3, 1998

[54] LIQUID DEVELOPER COMPOSITIONS WITH RHODAMINE

[75] Inventors: Scott D. Chamberlain, Macedon; John W. Spiewak, Webster; David H. Pan, Rochester; George A. Gibson; Christopher M. Knapp, both of Fairport; Roger N. Ciccarelli, Rochester, all of N.Y.

[73] Assignee: Xerox Corporation, Stamford, Conn.

[21] Appl. No.: 779,191

[22] Filed: Jan. 6, 1997

[51] Int. Cl.[6] ..... G03G 9/135

[52] U.S. Cl. ..... 430/115; 430/106

[58] Field of Search ..... 430/115, 106

[56] References Cited

U.S. PATENT DOCUMENTS

| | | | |
|---|---|---|---|
| 4,707,429 | 11/1987 | Trout | 430/115 |
| 5,019,477 | 5/1991 | Felder | 430/115 |
| 5,308,731 | 5/1994 | Larson et al. | 430/115 |
| 5,324,613 | 6/1994 | Ciccarelli et al. | 430/110 |
| 5,366,840 | 11/1994 | Larson et al. | 430/115 |
| 5,563,015 | 10/1996 | Bonsignore et al. | 430/106 |
| 5,565,299 | 10/1996 | Gibson et al. | 430/137 |

OTHER PUBLICATIONS

Chemical Abstracts: Pigment Red 81:3, 1997.

Chemical Abstracts: Rhodamine Y, 1997.

Diamond, Arthur S. Handbook of Imaging Materials. New York: Marcel-Dekker, Inc. pp. 230–236, 1991.

*Primary Examiner*—Christopher D. Rodee

*Attorney, Agent, or Firm*—E. O. Palazzo

[57] ABSTRACT

A positively charged liquid developer comprised of a non-polar liquid, thermoplastic resin particles, pigment, a charge director, and a charge control agent comprised of Rhodamine Y.

20 Claims, No Drawings

LIQUID DEVELOPER COMPOSITIONS WITH RHODAMINE

PENDING PATENT APPLICATIONS

Illustrated in U.S. Pat. No. 5,627,002, the disclosure of which is totally incorporated herein by reference, is a liquid developer with cyclodextrins as charge control agents, and in copending application U.S. Ser. No. 778,990 U.S. Pat. No. 5,688,624, the disclosure of which is totally incorporated herein by reference, are liquid developers with polyethylene oxide/polypropylene oxide charge control agents, or additives. In copending application U.S. Ser. No. 778,855 U.S. Pat. No. 5,672,456, the disclosure of which is totally incorporated herein by reference, there is illustrated a liquid developer with aluminum complex charge directors.

BACKGROUND OF THE INVENTION

This invention is generally directed to liquid developer compositions and the excellent developed images obtained thereof, especially in electrographic image on image printing processes wherein a stylus provides, or writes the image pattern on a dielectric receptor, and more specifically, the present invention relates to a liquid developer containing certain charge control agents. More specifically, the present invention relates to positively charged liquid developers comprised of a nonpolar liquid, pigment or dye, resin, Rhodamine Y, CI Pigment Red 81:3, a benzoic acid, 2-[6-ethylamino-3-ethylimino-2,7-dimethylxanthen-9-yl]-ethyl ester, molybdate, charge control agent (CCA) and a charge director, and which developers possess a number of advantages including the development and generation of images with improved image quality, especially with respect to four color, four pass ionographic development systems, like the Xerox Corporation ColorgrafX 8900 printers, and wherein the developed images are of high quality and excellent resolution. The developers of the present invention in embodiments provide images with higher, for example from about 1.26 to about 1.36, reflective optical density (ROD) and/or low residual voltages ($V_{out}$), for example from about less than or equal to 10, and more specifically, from about 8 to about 12. Higher reflective optical densities provide images with deeper, richer desirable color or more extended chroma. Lower residual image voltages enable the printing of subsequently applied layers to a higher reflective optical density and decrease or eliminate image defects such as smearing and shifts in L*a*b* color space (hue shifts) when one colored layer is overlaid on a second layer of different color. Series-Capacitance Data was utilized as a means of measuring the total charge in the liquid developer formulation, and which measurements indicate that placing too much charge on the toner or developer particles can cause lower ROD's (reflective optical density) to occur, which is a manifestation of inferior image quality since less chroma occurs. Moreover, there can be added to the liquid developers of the present invention in embodiments thereof charge directors including those of the formulas as illustrated in U.S. Pat. No. 5,563,015, especially a mixture of Alohas and EMPHOS PS-900™, Alohas alone, an abbreviation for an aluminum-di-tertiary butyl salicylate, or E-88™ available from Orient Chemicals, the disclosure of this patent being totally incorporated herein by reference.

PRIOR ART

Developers can discharge the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems wherein, for example, insufficient particle charge can result in poor image quality and also can result in poor transfer of the liquid developer or solids thereof to paper or other final substrates. Poor transfer can, for example, result in poor solid area coverage if insufficient toner is transferred to the final substrate and can also cause image defects such as smears and hollowed fine features. Conversely, overcharging the toner particles can result in low reflective optical density images or poor color richness or chroma since only a few very highly charged particles can discharge all the charge on the dielectric receptor causing too little toner to be deposited. To overcome or minimize such problems, the liquid toners, or developers of the present invention were arrived at after extensive research, and which developers result in, for example, sufficient particle charge to enable effective transfer but not, for example, too much charge as to yield images with lower optical densities and lower residual voltages because of excess toner charge. An advantage associated with the present invention includes controlling the increase of the desired positive charge on the developer particles.

A latent electrostatic image can be developed with toner particles dispersed in an insulating nonpolar liquid. These dispersed compositions are known as liquid toners or liquid developers. A latent electrostatic image may be generated by providing a photoconductive imaging member or layer with a uniform electrostatic charge, and developing the image with a liquid developer. The colored toner or solid particles are dispersed in a nonpolar liquid which generally has a high volume resistivity in excess of $10^9$ ohm-centimeters, a low dielectric constant, for example below 3.0, and a high vapor pressure. Generally, the toner particles are less than 30 μm (microns) average by area size as measured with the Malvern 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate. As the copolymer with polyethylene and methacrylic acid or methacrylic acid alkyl esters, NUCREL® may be selected.

U.S. Pat. No. 5,030,535 discloses a liquid developer composition comprising a liquid vehicle, a charge control additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

In U.S. Pat. No. 4,707,429 there are illustrated, for example, liquid developers with an aluminum stearate charge adjuvant. Liquid developers with charge directors are also illustrated in U.S. Pat. No. 5,045,425. Also, stain elimination in consecutive colored liquid toners is illustrated in U.S. Pat. No. 5,069,995. Further, of interest with respect to liquid developers are U.S. Pat. Nos. 5,034,299; 5,066,821 and 5,028,508, the disclosures of which are totally incorporated herein by reference.

Illustrated in U.S. Pat. No. 5,306,591 is a liquid developer comprised of a liquid component, thermoplastic resin; an ionic or zwitterionic charge director, or directors soluble in a nonpolar liquid; and a charge additive, or charge adjuvant comprised of an imine bisquinone; in U.S. Statutory Invention Registration No. H1483 there is disclosed a liquid developer comprised of thermoplastic resin particles, and a charge director comprised of an ammonium AB diblock copolymer, and in U.S. Pat. No. 5,307,731 there is illustrated a liquid developer comprised of a liquid, thermoplastic resin particles, a nonpolar liquid soluble charge director, and a charge adjuvant comprised of a metal hydroxycarboxylic acid, the disclosures of each of these patents and Statutory Invention Registration being totally incorporated herein by reference.

SUMMARY OF THE INVENTION

Examples of objects of the present invention include:

It is an object of the present invention to provide a liquid developer with many of the advantages illustrated herein.

Another object of the present invention resides in the provision of a liquid developer capable of controlled or modulated particle charging for image quality optimization.

It is a further object of the invention to provide a positively charged liquid developer, especially magenta and black developers, wherein there are selected as charge control agents or additives certain Rhodamines.

It is still a further object of the invention to provide positively charged liquid developers wherein developed image defects, such as smearing, loss of resolution and loss of density, and color shifts in prints having black images overlaid with cyan or other suitable colored images are eliminated or minimized.

Also, in another object of the present invention there are provided positively charged liquid developers with certain charge control agents that are in embodiments superior to liquid developers with no charge additive, and which positively charged developers result in higher reflective optical density (ROD) and/or lower residual($V_{out}$) for developed images.

Furthermore, in another object of the present invention there are provided liquid toners that enable excellent image characteristics, and which toners enhance the positive charge of the resin, such as ELVAX®, based colored toners.

In embodiments the present invention relates to liquid developers. The present invention in embodiments is directed to liquid developers comprised of a nonpolar liquid, pigment, resin, preferably thermoplastic resin, a Rhodamine Y charge control agent, and a charge director, such as the aluminum salts of alkylated salicylic acid, like, for example, hydroxy bis[3,5-tertiary butyl salicylic]aluminate, or a mixture of the aluminum salts of alkylated salicylic acid, like, for example, hydroxy bis[3,5-tertiary butyl salicylic] aluminate and EMPHOS PS-900™, reference U.S. Pat. No. 5,563,015, the disclosure of which is totally incorporated herein by reference.

More specifically, the present invention relates to a positively charged liquid developer comprised of a nonpolar liquid, thermoplastic resin particles, an optional charge adjuvant, optional pigment, a Rhodamine Y charge control agent or additive, and a charge director comprised of a mixture of I. a nonpolar liquid soluble organic phosphate mono and diester mixture derived from phosphoric acid and isotridecyl alcohol, and preferably EMPHOS PS-900™ and II. a nonpolar liquid soluble organic aluminum complex, or mixtures thereof of the formulas

I.

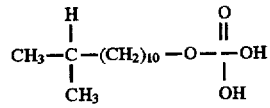

mono

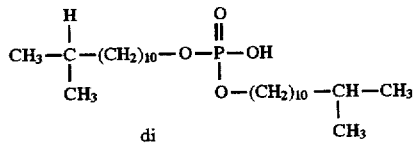

di

II.

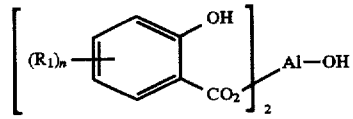

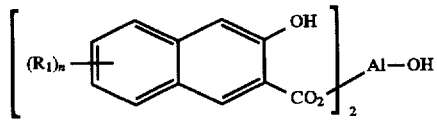

wherein $R_1$ is selected from the group consisting of hydrogen and alkyl, and n represents a number, such as from 1 to about 6.

Of importance with respect to the present invention is the selection of Rhodamine Y charge control agent, which agent is mixed with the toner resin and pigment, and thereafter a charge director is added thereto. The Rhodamine Y generic name is CI Pigment Red 81:3, its common name is Rhodamine Y (SMA), and its chemical abstract index name is benzoic acid, 2-[6-ethylamino-3-ethylimino-2,7-dimethyl xanthen-9-yl]-ethyl ester, molybdate silicate.

In embodiments of the present invention, the Rhodamine Y is selected in various effective amounts, such as for example from about 0.05 to about 10, and preferably from about 3 to about 7 weight percent based on the total weight percent of the solids of resin, pigment, and charge additive. For example, when 5 weight percent of Rhodamine Y is selected, 55 weight percent of resin, and 40 weight percent of pigment is selected.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than about $5\times10^{9}$·ohm/cm, such as $5\times10^{13}$. Preferably, the liquid selected is a branched chain aliphatic hydrocarbon. A nonpolar liquid of the ISOPAR® series, obtainable from Exxon Corporation, may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197° C.; ISOPAR L® is between about 188° C. and about 206° C.; ISOPAR® is between about 207° C. and about 254° C.; and ISOPAR V® is between about 254.4° C. and about 329.4° C. ISOPAR L® has a mid-boiling point of approximately 194° C. ISOPAR® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^{e}$ ohm-centimeters and a dielectric constant below 3.0 in embodiments of the present invention. Moreover, the vapor pressure at 25° C. should be less than 10 Torr in embodiments.

While the ISOPAR® series liquids can be a preferred nonpolar liquid for use as dispersant in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 85 to about 99.9 percent, and preferably from about 90 to about 99 percent by weight of the total developer dispersion, however, other effective amounts may be selected. The total solids, which include resin, pigment and the Rhodamine Y charge control additive content of the developer in embodiments is, for example, from about 0.1 to about 15 percent by weight, or parts preferably from about 0.3 to about 10 percent, and more preferably from about 0.5 to about 10 percent by weight.

Typical suitable thermoplastic toner resins can be selected for the liquid developers of the present invention in effective amounts, for example, in the range of from about 99.9 percent to about 40 percent, and preferably from about 80 percent to about 50 percent of developer solids comprised of thermoplastic resin, pigment, charge control agent, and in embodiments other solid components that may comprise the developer. Generally, developer solids include the thermoplastic resin, pigment and charge control agent. Examples of resins include ethylene vinyl acetate (EVA) copolymers (ELVAX® resins, E. I. DuPont de Nemours and Company, Wilmington, Del.); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Connecticut); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof.

The liquid developers of the present invention may optionally contain, and preferably does contain in embodiments a colorant dispersed in the resin particles. Colorants, such as pigments or dyes and mixtures thereof, are preferably present to render the latent image visible. The colorant may be present in the developer in an effective amount of, for example, from about 0.1 to about 60 percent, from about 10 to about 50, and in embodiments from about 1 to about 10 percent by weight based on the total weight of solids contained in the developer. The amount of colorant selected may vary depending, for example, on the developer usage. Examples of pigments which may be selected include carbon blacks available from, for example, Cabot Corporation, FANAL PINK™, PV FAST BLUE™, those pigments as illustrated in U.S. Pat. No. 5,223,368, the disclosure of which is totally incorporated herein by reference; other known pigments; and the like, with the preferred pigment being carbon black.

Examples of charge directors present in various effective amounts of, for example, from about 0.001 to about 5, and preferably from about 0.005 to about 1 weight percent or parts, include those as illustrated in U.S. Pat. Nos. 5,366,840 and 5,324,613, the disclosures of which are totally incorporated herein by reference, such as aluminum di-tertiary-butyl salicylate; hydroxy bis[3,5-tertiary butyl salicylic] aluminate; hydroxy bis[3,5-tertiary butyl salicylic] aluminate mono-, di-, tri- or tetrahydrates; hydroxy bis[salicylic] aluminate; hydroxy bis[monoalkyl salicylic] aluminate; hydroxy bis[dialkyl salicylic]aluminate; hydroxy bis [trialkyl salicylic] aluminate; hydroxy bis[tetraalkyl salicylic] aluminate; hydroxy bis[hydroxy naphthoic acid] aluminate; hydroxy bis[monoalkylated hydroxy naphthoic acid] aluminate; bis[dialkylated hydroxy naphthoic acid] aluminate wherein alkyl preferably contains 1 to about 6 carbon atoms; bis[trialkylated hydroxy naphthoic acid] aluminate wherein alkyl preferably contains I to about 6 carbon atoms; bis[tetraalkylated hydroxy naphthoic acid] aluminate wherein alkyl preferably contains 1 to about 6 carbon atoms; and the like.

To further increase the toner or particle charge and, accordingly, increase the mobility and transfer latitude of the toner particles, charge adjuvants can be added to the developer solids in embodiments. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. These types of adjuvants can assist in enabling improved developer charging characteristics, namely, an increase in particle charge that results in improved electrophoretic mobility and improved image development, and transfer to allow superior image quality with improved solid area coverage and resolution in embodiments. The adjuvants can be added to the developer solids in an amount of from about 0.1 percent to about 15 percent of the total developer solids, and preferably from about 3 percent to about 7 percent of the total weight percent of solids contained in the developer.

The liquid electrostatic developer of the present invention can be prepared by a variety of processes such as, for example, mixing in a nonpolar liquid the thermoplastic resin, Rhodamine Y charge control agent, and colorant, especially pigment, in a manner that the resulting mixture contains, for example, about 30 to about 60 percent by weight of solids; heating the mixture to a temperature of from about 40° C. to about 110° C. (Centigrade) until a uniform dispersion is formed; adding an additional amount of nonpolar liquid sufficient to decrease the total solids concentration of the developer to about 10 to about 30 percent by weight; cooling the dispersion to about 10° C. to about 30° C.; adding a charge director, such as an aluminum complex charge director compound, to the dispersion; and diluting the dispersion.

In the initial mixture, the resin, colorant and charge control agent may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of from about 0.04 to about 0.5 inch (approximately 1.0 to approximately 13 millimeters).

Sufficient nonpolar liquid is added to provide a dispersion of from about 30 to about 60 percent solids. This mixture is then subjected to elevated temperatures during the initial mixing procedure to plasticize and soften the resin. The mixture is sufficiently heated to provide a uniform dispersion of all the solid materials of, for example, colorant, charge director, charge control, and resin. However, the temperature at which this step is undertaken should not be so high as to degrade the nonpolar liquid or decompose the resin or colorant if present. Accordingly, the mixture in embodiments is heated to a temperature of from about 50° C. to about 110° C, and preferably from about 50° C. to about 80° C. The mixture may be ground in a heated ball mill or heated attritor at this temperature for about 15 minutes to about 5 hours, and preferably about 60 to about 180 minutes.

After grinding at the above temperatures, an additional amount of nonpolar liquid may be added to the dispersion. The amount of nonpolar liquid to be added should be sufficient in embodiments to decrease the total solids concentration of the dispersion to about 10 to about 30 percent by weight.

The dispersion is then cooled to about 10° C. to about 30° C., and preferably to about 15° C. to about 25° C., while mixing is continued until the resin admixture solidifies or hardens. Upon cooling, the resin admixture precipitates out of the dispersant liquid. Cooling is accomplished by methods such as the use of a cooling fluid like water, glycols such as ethylene glycol, in a jacket surrounding the mixing vessel. Cooling is accomplished, for example, in the same vessel, such as an attritor, while simultaneously grinding with particulate media to prevent, or minimize the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 4 hours. Additional liquid may be added at any time during the preparation of the liquid developer to facilitate grinding or to dilute the developer to the appropriate percent solids needed for developing. Thereafter, the charge director is added. Other processes of preparation are generally illustrated in U.S. Pat. Nos. 4,760,009; 5,017,451; 4,923,778; and 4,783,389, the disclosures of which are totally incorporated herein by reference.

As illustrated herein, the developers or inks of the present invention can be selected for imaging and printing methods wherein, for example, a latent image is formed on a photoconductive imaging member, reference for example selenium, selenium alloys, layered photoconductive imaging members, such as those illustrated in U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating. The developers of the present invention are especially useful in the Xerox Corporation ColorgrafX Systems 8900 series printers.

Embodiments of the invention will be illustrated in the following nonlimiting Examples. The toner or solids particle size can range from about 0.1 to about 3.0 micrometers and the preferred particle size range is from about 0.5 to about 1.5 micrometers. Particle size, when measured, was measured by a Horiba CAPA-500 centrifugal automatic particle analyzer manufactured by Horiba Instruments, Inc., Irvine, Calif. The total developer charge (Q in microcoulombs) was measured using the series-capacitor technique. The charge was measured at 400 volts for 0.05 second.

Series-Capacitor Technique

The electrical properties of liquid developers can be reviewed using a series-capacitor method, which is a well-established method for determining the dielectric relaxation time in partially conductive materials as, for example, might be found in "leaky" capacitors, reference U.S. Pat. No. 5,459,077, the disclosure of which is totally incorporated herein by reference.

Two series capacitors can be used. One is comprised of a dielectric layer (MYLAR®) which corresponds to the photoreceptor, the other is comprised of a layer of liquid (ink). Although a constant bias voltage is maintained across the two capacitors, the voltage across the ink layer decays as the charged particles within it move. Measurement of the external currents allows the observation of the decay of voltage across the ink layer. Depending on the composition of the ink layer, this reflects the motion of charged species, in real time, as in the various, actual liquid immersion development processes of this invention. Control Examples are also provided.

Application of a co-developed theoretical analysis, together with a knowledge of the dielectric thicknesses of the MYLAR® and ink layers, the applied bias voltage and the observed current, enables the measurement of the total collected charge (Q).

EXAMPLES

Control 1A=40 Percent of Black Pearl L; No CCA:

One hundred sixty-two (162.0) grams of ELVAX 200W® (a copolymer of ethylene and vinyl acetate with a melt index at 190° C. of 2,500, and available from E. I. DuPont de Nemours & Company, Wilmington, Del.), 108.0 grams of the black pigment (Black Pearl L obtained from Hoechst) and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. (Centigrade) for 2 hours. Subsequently, 675 Grams of ISOPAR-G® was added to the attritor at the conclusion of 2 hours, and cooled to 23° C. by running water through the attritor jacket, and followed by grounding in the attritor for an additional 2 hours. Additional ISOPAR-G®, about 300 grams, was added and the mixture was separated from the steel balls.

To 907.26 grams of the resulting mixture (14.88 percent solids) were added 3,570.24 grams of ISOPAR-G® (Exxon Corporation), and 45.0 grams of Alohas charge director (3 weight percent in ISOPAR-M®) to provide a charge director level of 10 milligrams of charge director per gram of toner solids (Control 1A). The charge of the resulting liquid toner or developer after print testing with a Xerox Corporation 8954 throughout was measured by the series capacitance method and was found to be 0.13 for the Control 1A developer.

Alohas is an abbreviation for hydroxy bis(3,5-di-tertiary butyl salicylic) aluminate monohydrate, reference for example U.S. Pat. Nos. 5,366,840 and 5,324,613, the disclosures of which are totally incorporated herein by reference.

Control 2A=40 Percent of Black Pearl L; 4.8 Percent of PEO:PPO (Pluronic F-108):

One hundred sixty-two (162.0) grams of ELVAX 200W® (a copolymer of ethylene and vinyl acetate with a melt index at 190° C. of 2,500, and available from E.I. DuPont de Nemours & Company, Wilmington, Del.), 108.0 grams of the black pigment (Black Pearl L obtained from Cabot Corporation), 13.5 grams of the charge additive PEO:PPQ (Pluronic F-108, obtained from BASF), and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. Thereafter, 675 grams of ISOPAR-G® were added to the attritor at the conclusion of 2 hours, and cooled to 23° C. by running water through the attritor jacket, and ground in the attritor for an additional 2 hours. Additional ISOPAR-G®, about 300 grams, was added and the mixture was separated from the steel balls.

To 891.09 grams of the mixture (15.15 percent solids) were added 3,586.41 grams of ISOPAR-G® (Exxon Corporation), and 45.0 grams of Alohas charge director (3 weight percent in ISOPAR-®) to provide a charge director level of 10 milligrams of charge director per gram of toner solids (Control 2A). The charge of the resulting liquid toner or developer after print testing was measured by the series capacitance method and was found to be 0.19 for the Control 2A developer.

Control 3A=40 Percent of Black Pearl L; 6.5 Percent of beta-Cyclodextrin CCA:

One hundred sixty-two (162.0) grams of ELVAX 200W® (a copolymer of ethylene and vinyl acetate with a melt index at 190° C. of 2,500, available from E. I. DuPont de Nemours & Company, Wilmington, Del.), 108.0 grams of the black pigment (Black Pearl L obtained from Hoechst), 18.9 grams of the charge additive beta-cyclodextrin, obtained from Cerestar, Inc., and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. Subsequently, 675 Grams of ISOPAR-G® were added to the attritor after 2 hours, and cooled to 23° C. by running water through the attritor jacket, and ground in the attritor for an additional 2 hours. Additional ISOPAR-G®, about 300 grams, was added and the mixture was separated from the steel balls.

To 885.36 grams of the mixture (15.248 percent solids) were added 3,592.14 grams of ISOPAR-G® (Exxon Corporation), and 45.0 grams of Alohas charge director (3 weight percent in ISOPAR-M®) to provide a charge director level of 10 milligrams of charge director per gram of toner solids (Control 3A). The charge of the resulting liquid toner or developer after print testing was measured by the series capacitance method and was found to be 0.17 for the Control 3A developer.

Example 1A=40 Percent of Black Pearl L; 5 Percent of Rhodamine Y CCA:

One hundred forty-eight point five (148.5) grams of ELVAX 200W® (a copolymer of ethylene and vinyl acetate with a melt index at 190° C. of 2,500, available from E.I. DuPont de Nemours & Company, Wilmington, Del.), 108.0 grams of the black pigment (Black Pearl L obtained from Hoechst), 13.5 grams of the charge additive Rhodamine Y (Sun Chemicals) and 405 grams of ISOPAR-M® (Exxon Corporation) were added to a Union Process O1 attritor (Union Process Company, Akron, Ohio) charged with 0.1857 inch (4.76 millimeters) diameter carbon steel balls. The mixture was milled in the attritor which was heated with running steam through the attritor jacket at 56° C. to 86° C. for 2 hours. Subsequently, 675 Grams of ISOPAR-G® were added to the attritor at the conclusion of 2 hours, and cooled to 23° C. by running water through the attritor jacket, and ground in the attritor for an additional 2 hours. Additional ISOPAR-G®, about 300 grams, was added and the mixture was separated from the steel balls.

To 597.13 grams of the mixture (15.072 percent solids) were added 2,387.87 grams of ISOPAR-G®(Exxon Corporation), and 30.0 grams of Alohas charge director (3 weight percent in ISOPAR-M®) to provide a charge director level of 10 milligrams of charge director per gram of toner solids (Example 1A). The charge of the resulting liquid toner or developer after print testing (all print testing was completed in a Xerox Corporation ColorgrafX System 8954, a 54 inch wide multiple pass ionographic printer), was measured by the series capacitance method and was found to be 0.34 for the Example 1A developer.

The printer parameters were adjusted to obtain a contrast of 50 and a speed of 4.0 ips by inputting values on the control panel. After single pass prints were made with the above parameter settings using the standard test printing mode (sail patterns), the residual development voltage was measured using an Electrostatic Volt Meter (Trek Model No. 565). This value was shown as residual voltage [($V_{out}$)]. This parameter was valuable because it was a measurement used to predict the amount of undesired color shifting (also referred to as staining) of the developed toner layer upon subsequent development passes. The reflective optical density (ROD), a color intensity measurement of chroma, was measured with a MacBeth 918 color densitometer using the substrate paper background as a reference. The paper used to test print these images was Rexham 6262.

A series of measurements were accomplished with the following results:

For Control 1A, which contained 40 weight percent of Black Pearl L pigment and zero weight percent of CCA, and wherein the milligrams of charge director per gram of toner solids was 10/1 of Alohas, the total charge of the developer in microcoulombs was 0.13, the reflective optical density was 1.16, and the residual voltage was 15.

For Control 2A, which contained 40 weight percent of Black Pearl L pigment and 4.8 percent of PEO:PPO (Pluronic F-108) CCA, and wherein the milligrams of charge director per gram of toner solids was 10/1 of Alohas, the total charge of the developer in microcoulombs was 0.19, the reflective optical density was 1.08, and the residual voltage was 15.

For Control 3A, which contained 40 weight percent of Black Pearl L pigment and 6.5 percent of beta-Cyclodextrin CCA, and wherein the milligrams of charge director per gram of toner solids was 10/1 of Alohas, the total charge of the developer in microcoulombs was 0.17, the reflective optical density was 1.24, and the residual voltage was 15.

For Example 1A, which contained 40 weight percent of Black Pearl L pigment and 5 Percent of Rhodamine Y CCA, and wherein the milligrams of charge director per gram of toner solids was 10/1 of Alohas, the total charge of the developer in microcoulombs was 0.34, the reflective optical density was 1.29, and the residual voltage was 10.

For improved image quality in multilayered images, it is preferred that RODs increase, which increase permits more intense color or chroma, and $V_{outs}$ decrease, which minimize color staining or hue shifts of a black image after overcoating said black image with a cyan toner. The thickness of a developed layer, for example black, is dependent upon the charging level (proportional to applied voltage) on the dielectric receptor. Since a constant voltage is generally applied to the dielectric receptor in development of all layers in a multilayered image, large residual voltages, as might occur after development of the black layer, add to the applied voltage resulting in a thicker cyan layer. A thicker cyan layer overlaid on the thinner black layer will cause the latter to color shift. Review of the measurements and data presented herein indicates that using no, or different charge additives, Controls 1 A, 2A and 3A, failed to increase the developer charging levels (total Q), and reflective optical densities (ROD) of the developed black images remained lower than desired. When 5 percent of Rhodamine Y CCA was incorporated into what was otherwise essentially the same black developer formulations as were used in Controls 1A, 2A and 3A, Example 1A black developers were produced with charging levels of 0.34 versus 0.13, 0.19 and 0.17 for the corresponding Control developers 1 A, 2A and 3A when using the same charge director (CD) and levels thereof. Although the RODs of the developed black layers increased slightly in Control 3A, they are still lower than that in Example 1A. By increasing the black developer charging level in Example 1A to 0.34 from less than 0.20 in Controls 1 A, 2A and 3A, it is believed that the conductivity of the developer also increased slightly causing the developed black layer residual voltage in Example 1A to decrease, while not decreasing reflective optical density (ROD of 1.29).

The incorporation of the Rhodamine Y charge control agents into the developer formulation modulates the initial developer charging level to a new developer charging level with a larger reflective optical density. Thus, the Rhodamine charge control component simultaneously tunes charging level (total Q), reflective optical density (ROD) and residual voltage $V_{out}$).

Disclosed are a positively charged liquid developer comprised of a nonpolar liquid, thermoplastic resin, pigment, a charge director, and a charge control agent comprised of Rhodamine Y, Pigment Red 81:3, and more specifically, wherein the Rhodamine Y is benzoic acid, 2-[6-ethylamino-3-ethylimino-2,7-dimethyl xanthen-9-yl]-ethyl ester, molybdate silicate; a liquid developer wherein the liquid has a viscosity of from about 0.5 to about 20 centipoise and a resistivity equal to or greater than about $5\times10^9$, and the thermoplastic resin has a volume average particle diameter, measured by known methods, such as a Coulter Counter, of from about 0.1 to about 30 microns; a developer wherein the pigment is carbon black, cyan, magenta, yellow or mixtures thereof; a developer wherein the charge control agent is present in an amount of from about 0.05 to about 10 weight percent based on the weight of the developer solids of resin, pigment and charge control agent; an imaging method which comprises forming an electrostatic latent image followed by the development thereof with the liquid developer of the present invention as illustrated herein; an ionographic imaging method which comprises charging a receptor followed by the development thereof with the developer of the present invention as illustrated herein; a developer with Rhodamine Y and wherein the charge director is comprised of a mixture of I. a nonpolar liquid soluble organic phosphate mono and diester mixture derived from phosphoric acid and isotridecyl alcohol, and II. a nonpolar liquid soluble organic aluminum complex, or mixtures thereof of the formulas

I.

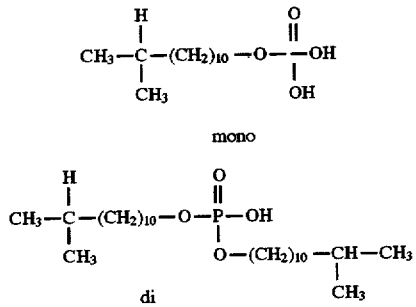

II.

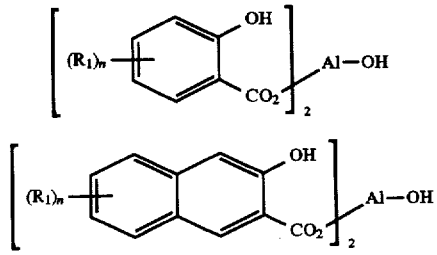

wherein $R_1$ is selected from the group consisting of hydrogen and alkyl, and n represents a number, such as from 1 to about 6; and a positively charged liquid developer comprised of a nonpolar liquid, thermoplastic resin particles, colorant, a charge director, and a charge control agent comprised of benzoic acid, 2-[6-ethylamino-3-ethylimino-2,7-dimethyl xanthen-9-yl]-ethyl ester, molybdate silicate.

Other embodiments and modifications of the present invention may occur to those of ordinary skill in the art subsequent to a review of the information presented herein; these embodiments and modifications, as well as equivalents thereof, are also included within the scope of the present invention.

What is claimed is:

1. A positively charged liquid developer comprised of a nonpolar liquid, thermoplastic resin, colorant, a charge director, and a charge control agent of benzoic acid, 2-[6-ethylamino-3-ethylimino-2,7-dimethylxanthen-9-yl]-ethyl ester, molybdate silicate.

2. A liquid developer in accordance with claim 1 wherein said liquid has a viscosity of from about 0.5 to about 20 centipoise and a resistivity equal to or greater than about $5\times10^9$, and said thermoplastic resin is of a volume average particle diameter of from about 0.1 to about 30 microns.

3. A developer in accordance with claim 1 wherein the resin is a copolymer of ethylene and vinyl acetate.

4. A developer in accordance with claim 1 wherein the liquid for said developer is an aliphatic hydrocarbon.

5. A developer in accordance with claim 4 wherein aliphatic hydrocarbon is a mixture of branched hydrocarbons, each of from about 8 to about 16 carbon atoms, or a mixture of normal hydrocarbons, each of from about 8 to about 16 carbon atoms.

6. A developer in accordance with claim 1 wherein the resin is an alkylene polymer, a styrene polymer, an acrylate polymer, a polyester, or mixtures thereof.

7. A developer in accordance with claim 1 wherein said charge director is a nonpolar liquid soluble organic aluminum complex.

8. A developer in accordance with claim 1 wherein said director is comprised of a mixture of I. a nonpolar liquid soluble organic phosphate mono and diester mixture derived from phosphoric acid and isotridecyl alcohol, and II. a nonpolar liquid soluble organic aluminum complex or mixtures thereof of the formulas

I.

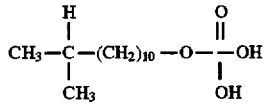

mono

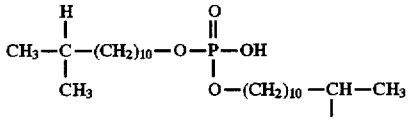

di

II.

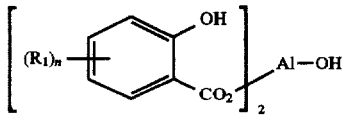

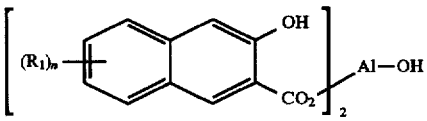

wherein $R_1$ is selected from the group consisting of hydrogen and alkyl, and n represents a number of from 1 to about 6.

9. A developer in accordance with claim 1 further containing a charge adjuvant.

10. An imaging method which comprises forming an electrostatic latent image followed by the development thereof with the liquid developer of claim 1.

11. An ionographic imaging method which comprises imagewise charging a receptor followed by the development thereof with the developer of claim 1.

12. A liquid developer comprised of a nonpolar liquid, thermoplastic resin particles, colorant, a charge director, and a charge control agent comprised of benzoic acid, 2-[6-ethylamino-3-ethylimino-2,7-dimethyl xanthen-9-yl]-ethyl ester, molybdate silicate.

13. A developer in accordance with claim 12 wherein the colorant is a pigment.

14. A developer in accordance with claim 13 wherein said pigment is black, a magenta pigment, a cyan pigment, a yellow pigment, or mixtures thereof.

15. A developer in accordance with claim 12 wherein said charge director is comprised of a mixture of I. a nonpolar liquid soluble organic phosphate mono and diester mixture derived from phosphoric acid and isotridecyl alcohol, and II. a nonpolar liquid soluble organic aluminum complex or mixtures thereof of the formulas

I.

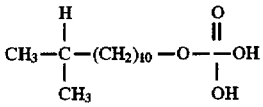

mono

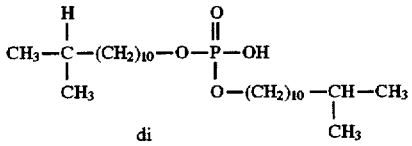

di

II.

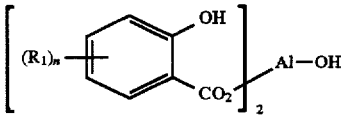

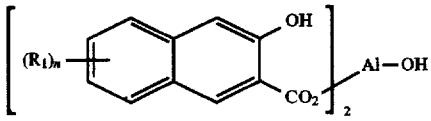

wherein $R_1$ is selected from the group consisting of hydrogen and alkyl, and n represents a number of from 1 to about 6.

16. A positively charged liquid developer comprised of a nonpolar liquid, thermoplastic resin, pigment, a charge director, and a charge control agent of benzoic acid, 2-[6-ethylamino-3-ethylimino-2,7-dimethyl xanthen-9-yl]-ethyl ester, molybdate silicate.

17. A developer in accordance with claim 16 wherein the pigment is present in an amount of from about 0.1 to about 60 percent by weight based on the total weight of the developer solids.

18. A developer in accordance with claim 16 wherein the pigment is carbon black, cyan, magenta, yellow or mixtures thereof.

19. A developer in accordance with claim 16 wherein the charge control agent is present in an amount of from about 0.05 to about 10 weight percent based on the weight of the developer solids of resin, pigment and charge control agent.

20. A developer in accordance with claim 16 wherein the pigment is carbon black.

* * * * *